United States Patent [19]

Reese et al.

[11] Patent Number: 5,066,199

[45] Date of Patent: Nov. 19, 1991

[54] METHOD FOR INJECTING TREATMENT CHEMICALS USING A CONSTANT FLOW POSITIVE DISPLACEMENT PUMPING APPARATUS

[75] Inventors: D. Dwaine Reese, Richmond; Roy D. Sawyer; Stanley G. Crow, both of Livingston, all of Tex.

[73] Assignee: Nalco Chemical Company, Naperville, Ill.

[21] Appl. No.: 425,566

[22] Filed: Oct. 23, 1989

[51] Int. Cl.[5] ..... F04B 1/02

[52] U.S. Cl. ..... 417/63; 417/521

[58] Field of Search ..... 417/521, 273, 63, 539; 92/165 PR

[56] References Cited

U.S. PATENT DOCUMENTS

| | | | |
|---|---|---|---|
| 2,697,403 | 12/1954 | Benedek | 417/521 |
| 3,323,461 | 6/1967 | Bennett | 417/539 |
| 3,816,029 | 6/1974 | Bowen | 417/539 |
| 4,192,223 | 3/1980 | Lombard | 92/165 PR |
| 4,453,898 | 6/1984 | Leka | 417/521 |

OTHER PUBLICATIONS

Bulletin 200–5, 200 Series Crane Chem/Meter Hydraulically Actuated Diaphragm Metering Pump, undated.

*Primary Examiner*—Robert G. Nilson

*Attorney, Agent, or Firm*—Arnold, White & Durkee

[57] ABSTRACT

A method for providing a continuous injection of a constant amount of a desired treatment chemical into a flowing stream is described. This method insures that the concentration of the desired treatment chemical is maintained at a relatively uniform concentration throughout the flowing stream. A constant flow pumping apparatus for providing the continuous injection of the treatment chemical is also described. The pumping apparatus includes multiple positive displacement pumps which are driven by a cam such that the rates of displacement of the displaceable members of the positive displacement pumps is a constant positive value. This insures that the pumping apparatus provides a constant flow of the treatment chemical being injected into a flowing stream. Providing a uniform concentration of a treatment chemical in a flowing stream maximizes the benefit of the treatment chemical. Conventional positive displacement pumps for injecting treatment chemicals provide intermittent injection of the treatment chemical such that sections of the flowing process stream have no concentration of the treatment chemical. This reduces the benefit of the treatment chemical and may prevent it from providing any benefit at all.

12 Claims, 4 Drawing Sheets

METHOD FOR INJECTING TREATMENT CHEMICALS USING A CONSTANT FLOW POSITIVE DISPLACEMENT PUMPING APPARATUS

BACKGROUND OF THE INVENTION

The invention relates to an improved method for injecting treatment chemicals into flowing streams and a novel pumping apparatus comprising two or more positive displacement pumps which provides a constant flow of the treatment chemical. Specifically, the injection method comprises the continuous and constant injection of a desired treatment chemical into a flowing stream to insure a uniform concentration of the treatment chemical in the stream. Further, the injection method is accomplished with a pumping apparatus comprising a novel cam in combination with two or more positive displacement pumps. The cam drives the positive displacement pumps so that at any given time the combined rate of liquid discharged by the positive displacement pumps is a constant value.

Conventional methods of injecting treatment chemicals into flowing streams use known positive displacement pumps which provide intermittent and nonconstant flow of the treatment chemicals. The concentration of the treatment chemicals is nonuniform due to the lack of axial dispersion of the treatment chemical in the flowing stream. The nonuniform concentration of the treatment chemical in the stream reduces the desired effect of the treatment chemical.

The hydrocarbon processing industry, chemical industry, oil production industry, water treatment industry, and other similar industries frequently use relatively small amounts of treatment chemicals to control undesirable occurrences in flowing streams in plants. The undesirable occurrences may take many forms such as corrosion, saltation, fouling, wax formation, scale formation, and polymerization in pipes or equipment. Corrosion, for example, deteriorates the metal in pipes and process equipment and may cause failure of the pipes or equipment. Likewise, Fouling and wax formation leads to plugging of the pipes or equipment when particular materials are deposited in the pipes and equipment due to undesirable chemical processes.

These problems vary in severity from minor annoyances in the operation of a plant to problems that halt operations of an entire plant. For example, a change from a nonacidic crude oil feedstock in an oil refinery to an acidic crude oil feedstock may cause pipes exposed to the acidic component of the crude oil to experience sudden and severe corrosion. The pipes may develop a hole within hours or days, and cause a processing unit or the whole refinery to shut down. Thus, the effective use of appropriate treatment chemicals to eliminate these problems is of paramount importance to the operation of a hydrocarbon processing plant or other plant.

Various treatment chemicals are available to remedy each of these problems in any particular application. Many chemical companies manufacture and sell treatment chemicals to alleviate specific problems for particular types of flowing streams. For example, Nalco Chemical Number 5192 made by Nalco Chemical Company may be used to prevent corrosion in overhead process streams.

Treatment chemicals are injected intermittently into flowing streams because the pumps used for this purpose provide an intermittent, nonconstant flow of the treatment chemical. Generally, pumps are used for many diverse purposes and many different types of pumps are available for different applications. For example, the chemical and petroleum refining industries use pumps in many applications. Pumps are also used in many everyday settings such as in household appliances and in automobiles. Usually, positive displacement pumps are used to inject treatment chemicals into flowing streams.

Pumps generally fall into two categories: (1) Centrifugal pumps; and (2) positive displacement pumps. Centrifugal pumps operate by applying centrifugal force to a liquid to cause it to flow. In a centrifugal pump liquid is introduced at the center of a rotating member with radial vanes. As the member rotates the liquid is forced to the edge of the member by centrifugal force and discharged.

Centrifugal pumps are the most commonly used type of pump. They are mechanically simple and provide a constant flow of liquid when pumping against a constant pressure. But they are not appropriate in some applications. Specifically, centrifugal pumps are not usually effective when flow rates of 1 gal/min or less are required. Further, centrifugal pumps are not effective for providing a precisely measured amount of liquid because their flow rate is dependent on the pressure they are pumping against. Also, they are not generally useful in applications which require high pressure. Centrifugal pumps have the added disadvantage that they increase the temperature of the fluid being pumped because some of the energy being applied to the fluid does not cause the fluid to move but instead increases the thermal energy of the fluid.

Positive displacement pumps generally operate by using a displaceable member to pull liquid into a chamber and then displace liquid from the chamber. Robert H. Perry and Cecil H. Chilton, Chemical Engineer's Handbook, page 6-3 (5th ed. 1973). The chamber of a positive displacement pump is the cavity formed between the displaceable member and the housing of the pump. The volume of the chamber varies as the displaceable member is moved. Many different devices are used to form the chambers and displaceable members of positive displacement pumps.

Positive displacement pumps, in contrast to centrifugal pumps, are ideal for providing a precisely measured flow of liquid. The flow rate delivered by a positive displacement pump depends only on the amount of liquid displaced during a stroke of the displaceable member and the number of strokes of the displaceable member during a given period of time. Further, the pressure that the positive displacement pump is working against has no effect on the flow rate delivered by the pump as it does in centrifugal pumps. Positive displacement pumps are also effective at providing low flow rates because very small displaceable members can be used which provide for a small amount of flow during each stroke of the displaceable member.

Many different types of positive displacement pumps are available. Piston pumps are one type of positive displacement pump. They incorporate a piston as their displaceable member. For example, a Milton-Roy pump incorporates one or more reciprocating pistons in cylinders. See, Chemicals Engineer's Handbook, supra at FIG. 6-23. The piston and cylinder form the chamber in which liquid to be pumped is alternately collected and then displaced. The piston pulls liquid into the chamber when the piston is moving in the direction during its stroke which increases the volume of the chamber, and discharges liquid when the piston is moving in the direction during its stroke which decreases the volume of the chamber.

Another type of a positive displacement pump is a diaphragm pump which incorporates a flexible diaphragm as its displaceable member. See, Chemical Engineer's Handbook, supra at FIGS. 6-24 and 6-25. The diaphragm is attached to a housing so that a chamber is formed between the diaphragm and housing. When the diaphragm is flexed away from the chamber liquid is pulled into the chamber, and when the diaphragm is flexed towards the chamber liquid is discharged from the chamber.

In either type of positive displacement pump the cycle of the pump includes two parts: A discharge stroke when liquid is discharged from the chamber and a suction stroke when liquid is pulled into the chamber.

The duration of the discharge stroke and the duration of the suction stroke are the same, and the combined duration for both strokes is the cycle time for the pump. The cycle time for positive displacement pumps ranges from about 0.6 to 1 second. Thus, for a positive displacement pump operating at full capacity, liquid is only being discharged only during 50 percent of the cycle time.

As a result of this type of pump cycle the flow rate of liquid delivered by a positive displacement pump is not constant and stops during the suction stroke. Further, the flow rate delivered by a positive displacement pump during a discharge stroke varies due to the means used to drive the displaceable member of the pump. The flow rate for each displaceable member during the discharge stroke tends to be represented by a sinusoidal wave. See, 1 E. Ludwig, Applied Process Design For Chemical And Petrochemical Plants, pages 121-22 (1964). Thus, the flow rate of liquid delivered by positive displacement pumps tends to be intermittent and pulsating. Attempts have been made to overcome this disadvantage by using multiple displaceable members with nonphased cycles so the suction stroke of one member will occur during the discharge of another piston. Id. The effect of adding the sinusoidal discharge rates for multiple out-of-phase displaceable members tends to produce a more constant flow of liquid but does not provide a truly constant flow. Further, these pumps tend to have more mechanical difficulties as the number of displaceable members is increased.

Typically, the amount of liquid discharged by positive displacement pumps may be varied from 10 percent of the pump's discharge capacity to the pump's full discharge capacity. In some positive displacement pumps this is accomplished by adjusting the pump so that it only discharges liquid during a portion of the pump discharge stroke. In other positive displacement pumps the liquid discharged is varied by changing the length of stroke. The result is a decrease in the total amount of liquid discharged by the pump.

The total amount of time that the positive displacement pump does not discharge liquid is the combined amount of time of the suction stroke and the amount of time during the discharge stroke when no liquid is being discharged. Consequently, if the pump is operating at less than full capacity for some positive displacement pumps, treatment chemicals will be injected into the flowing line less than 50 percent of the time.

When no treatment chemical is being discharged by a positive displacement pump the liquid of the flowing stream is continuing to flow past the injection point. This section of liquid is not being treated. With the pump at full capacity the section of liquid with no injected treatment chemical corresponds to the amount of liquid that flows past the injection point during the suction stroke. If the pump is operating at less than full capacity, this section of liquid corresponds to the amount of liquid that flows past the injection point during both the suction stroke and the portion of the discharge stroke when no liquid is discharged. At a minimum, 50 percent of the liquid in the flowing stream will not be injected with treatment chemical. And if the pump is operating at less than full capacity this percentage will be greater than 50 percent.

When treatment chemical is injected intermittently into a flowing stream the chemical will mix rapidly in a radial direction from the point of injection. Consequently, the concentration of the treatment chemical is relatively uniform across the cross-section of the flowing stream within a short distance from the point at which the treatment chemical is injected. This is due to the rapid radial mixing that occurs in the turbulent flow regime of most flowing streams.

Axial mixing, however, does not appear to occur rapidly in a flowing stream. It is generally a function of the nature of the flowing liquid, the nature of the injected liquid, and the flow regime of the flowing liquid. The nature of the flowing liquid and the treatment chemical are important to the extent that the liquids will tend to mix. For example, if the liquids have some chemical attraction to each other they will tend to mix. In the case of a polar treatment chemical being injected into a flowing polar liquid, the polar affinity between the treatment chemical and the flowing liquid will cause axial dispersion more quickly than would occur for a nonpolar treatment chemical injected into a flowing polar liquid.

The flow regime of a flowing fluid is dependent on the velocity of the flowing fluid, the geometry of the flow, and the density and viscosity of the flowing fluid at flow conditions. This relationship is calculated as the Reynold's Number of the flowing fluid. The Reynold's Number is a dimensionless quantity that represents the ratio between the inertial forces in a flowing fluid and the viscous forces in a flowing fluid. It is frequently used to correlate various parameters relating to the behavior of flowing fluids.

The Reynold's Number (Re) for a fluid flowing in a pipe is calculated by the following mathematical formula:

$$Re = DVp/\mu$$

where D is the pipe diameter in feet; V is the liquid velocity through the pipe in feet per second; p is the liquid density in pounds per cubic foot; and $\mu$ is the liquid viscosity in pounds per foot per second. See, Chemical Engineer's Handbook, supra at page 5-4, FIG. 5-26. For a given flow geometry (e.g. flow in a pipe) empirical data related to the Reynold's number indicates whether the flow regime of a flowing liquid is laminar or turbulent.

Laminar flow occurs at low flow velocities, and is characterized by minimal radial mixing on a microscopic scale on the flowing liquid. Further, laminar flow is characterized by different flow velocities for microscopic elements of the flowing liquid depending on the distance between the element of the flowing liquid and the wall of the pipe in which the liquid is flowing. This phenomena occurs because of the frictional forces exerted on the liquid by the pipe wall. Turbulent flow occurs at high flow velocities, and is characterized by extensive radial mixing and random variations in the flow velocities of microscopic elements of the liquid.

For a liquid flowing in a pipe the flow regime is generally laminar at Reynold's Numbers less than 3000, and turbulent at Reynold's Numbers greater than 3000. Typically, flowing streams have Reynold's Numbers in excess of 3000, and the liquids are flowing in a turbulent flow regime.

Reported studies have noted the degree to which axial dispersion will occur in flowing liquids in pipes. T. Sherwood, R. Pigford, and C. Wilke, Mass Transfer, McGraw-Hill Publishing Company, 1975, 137–141. These studies generally indicate that axial dispersion of a liquid in another flowing liquid correlates with the Reynolds number of the flowing liquid. Mass Transfer, supra at FIG. 4.17. More particularly the effective axial dispersion coefficient, which is a measure of the tendency for a liquid to axially disperse in another flowing liquid, will increase as the Reynold's Number for the flowing liquid increases.

Overall the concentration profile of a liquid injected into a flowing liquid in a turbulent flow regime will follow a Gaussian curve. Mass Transfer, supra at 138 and FIG. 4.16. Very little dispersion will occur at a point near the point of injection, and dispersion will gradually increase as the liquid flows farther from the point of injection.

For example, for two batches of oil flowing through a 12-inch pipeline at a velocity of 4 feet per second, the second batch of oil will only be dispersed into the proximate 750 feet of the first batch of oil after traveling 24 miles through the pipeline. Mass Transfer, supra at p. 140–41.

Referring to EXAMPLE 1 a test flow loop was constructed to study axial dispersion in a liquid flowing through a tube. Using a diaphragm pump, which provided an intermittent injection of red dye, it was observed that minimal dispersion of the red dye occurred 50 feet from the point of injection of the red dye into a flowing water stream. Further, large sections of the flowing water stream had no observable concentration of the red dye at all.

If this effect is scaled up to the size of typical plant streams it is evident that significant portions of a plant stream will not contain any concentration of a treatment chemical. For example, consider an overhead line in a crude oil processing unit with a 10 inch diameter which carries a flowing liquid with a velocity of 100 feet per second. A positive displacement pump is used to inject a treatment chemical such as a corrosion inhibitor into the overhead zone. The positive displacement pump is operated at 25 percent of its capacity because these pumps are typically sized to provide extra capacity.

If the pump operates at 1 cycle per second and is adjusted to deliver 25% of its capacity the treatment chemical will only be injected for $\frac{1}{8}$ of a second. The time period of no injection will be $\frac{7}{8}$ of a second. The suction stroke and discharge stroke each last $\frac{1}{8}$ second. Treatment chemical is injected during only 25 percent of the discharge stroke or $\frac{1}{8}$ second.

During the injection period of $\frac{1}{8}$ of a second the flowing stream will move 12.5 feet, and a section 12.5 feet long will contain the treatment chemical. During the period of no injection the flowing stream will move 87.5 feet and a section 87.5 feet long will contain no treatment chemical. Five seconds later the flowing stream will have traveled 500 feet. At which time, based on the flow loop test, the treated section will have slightly expanded from 12.5 feet and the untreated section will have slightly decreased from 87.5 feet.

The combined effect of intermittent injection of a treatment chemical into a flowing stream and the lack of axial dispersion of the treatment chemical in the flowing stream is that significant portions of the flowing stream will have no concentration of the treatment chemical. This problem increases as the velocity of the flowing stream increases relative to the time the pump does not inject treatment chemical because the amount of non-treated flowing stream correspondingly increases. Thus, the effectiveness of the treatment chemical is reduced. In fact, the treatment chemical may not provide any benefit at all under these conditions. Consequently, there is a need for a method that provides a continuous and constant injection of a treatment chemical into a flowing stream and an apparatus for providing a constant flow of the treatment chemical.

SUMMARY OF THE INVENTION

The invention comprises a method of continuously injecting a substantially constant amount of a treatment chemical into a flowing stream and a pumping apparatus which provides a constant flow (i.e., a flow of liquid which does not substantially vary in amount from one instant to the next) of the treatment chemical by using positive displacement pumps. This insures that the concentration of the treatment chemical is relatively uniform throughout the flowing stream and maximizes the benefit of the treatment chemical. The method can be used to inject many different treatment chemicals in a wide range of applications.

The pumping apparatus comprises two or more positive displacement pumps driven by a cam which displaces the displaceable members of the pumps so that the sum of the rates of change in the displacement for each displaceable member is a constant value. Preferably, the cam has a surface that is designed so that the sum of the rates of change in the distance between the surface and the center of rotation of the cam at points 180 degrees apart on the cam surface as the cam rotates in a particular direction, is a constant value. The points on the cam surface which are 180 degrees apart contact and drive two displaceable members of positive displacement pumps. The rate of change in distance between the cam surface and the center of rotation of the cam is a positive number when the distance is increasing and taken as zero when this distance is decreasing. The distance is increasing during the discharge stroke of the positive displacement pump which contacts the cam surface at that point, and the distance is decreasing during the suction stroke of the positive displacement pump which contacts the cam surface at that point.

Conventional methods of injecting treatment chemicals provide intermittent and nonconstant injection of the treatment chemical into the flowing stream, and result in reduced effectiveness of the treatment chemical. The constant injection method of the invention may be used to increase the effectiveness of any treatment chemical. It provides a superior effect for the same amount of a treatment chemical otherwise injected intermittently by providing a uniform concentration in the flowing stream. Likewise, it can reduce the amount of treatment chemical otherwise needed using intermittent injection to achieve a certain effect. Further, the method of the invention may allow the use of treatment chemicals in particular application in which they were ineffective using conventional injection methods.

The pumping apparatus of the invention provides a constant flow while using two or more positive displacement pumps. It controls the rates of displacement of the displaceable members used in the positive displacement pumps so that the sum will be a constant value. Thereby insuring that liquid is discharged at a constant rate because liquid is discharged by the positive displacement pumps at a rate proportional to the rate of displacement of their displaceable members during their discharge strokes. In this way the advantages of a positive displacement pump such as low flow rates and a precisely measured flow rate can be provided along with constant flow by the pumping apparatus of the invention. The pumping apparatus may be used in any situation which requires a constant flow of liquid.

DETAILED DESCRIPTION OF THE INVENTION

CONSTANT RATE INJECTION METHOD

Figure 1:
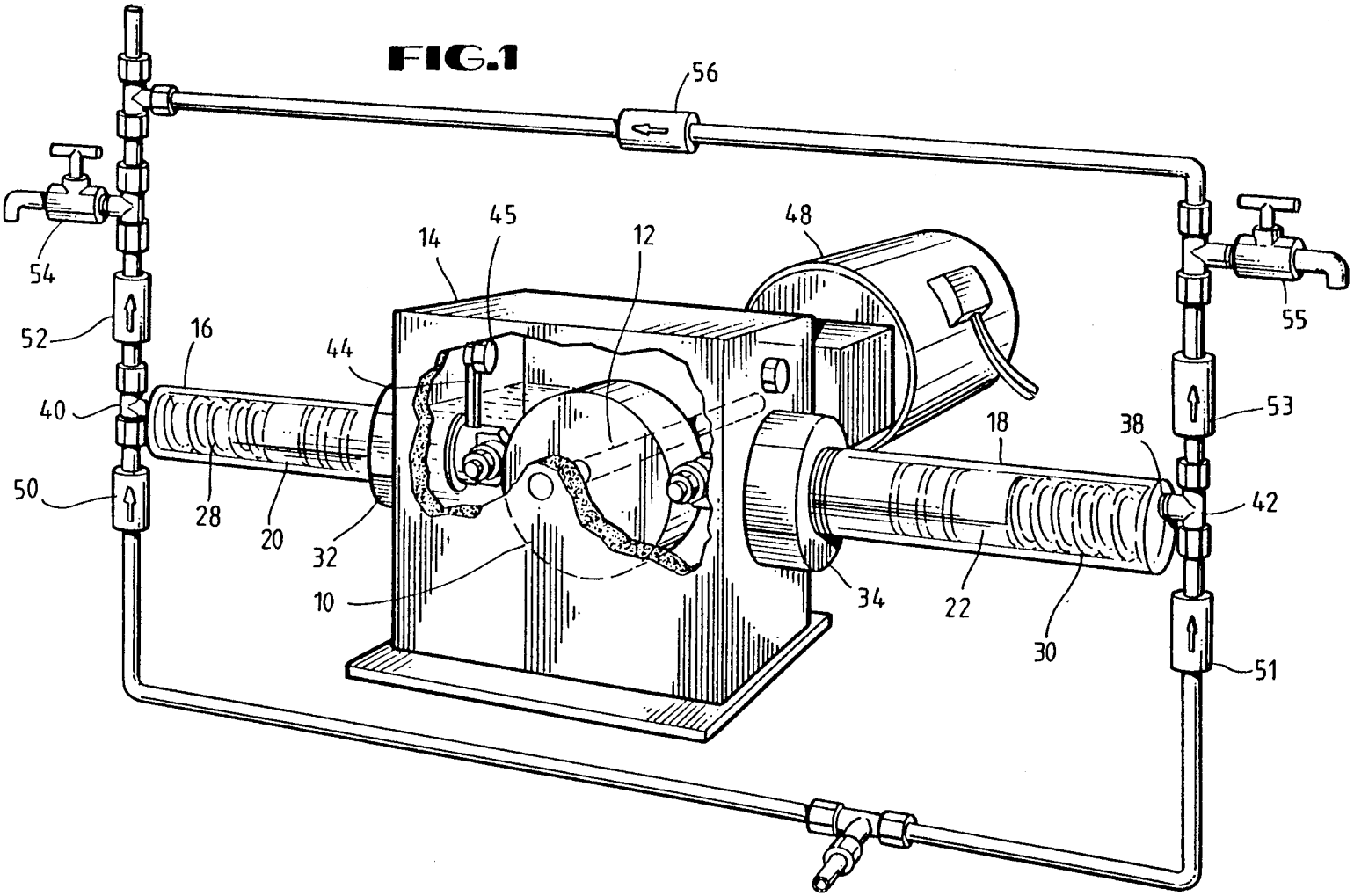
FIG. 1 depicts a schematic view of the constant flow positive displacement pump.

The method of the invention provides a constant injection of a treatment chemical into a flowing stream so that a uniform concentration of the treatment chemical is maintained in the flowing stream. The use of constant injection of treatment chemicals has achieved superior treatment results relative to the use of pulsating or intermittent injection of treatment chemicals, and has achieved positive results in some applications for which the use of intermittent injection achieved no benefits.

The method may be used to inject treatment chemicals into virtually any flowing stream. The nature of the flowing stream may vary greatly and includes many varieties of flowing fluids. It may comprise water at normal conditions such as cooling tower water or may comprise oil such as diesel fuel at elevated temperatures or pressures. Further, the flowing stream may include liquids or gases or a mixture thereof.

Flowing streams are typically contained by a pipe or conduit. They may flow from one piece of processing equipment to another or from one part of a processing unit to another part. In most instances the flowing stream is under pressure, and may also be at elevated or reduced temperatures.

A broad variety of treatment chemicals may be injected using the constant injection method. Some examples include corrosion inhibitors, neutralizing agents, anti-fouling agents, anti-scaling agents, dewaxing agents, anti-polymerization agents, acids, bases, oxygen scavengers, chemical catalysts, dyes, crystal modifiers, biocides, foam control agents, oxidizing agents, reducing agents, bleaches, sizing agents, buffering agents, and mixtures thereof.

The constant injection method requires a supply of the desired treatment chemical. Typically, this is a container of the desired treatment chemical. For example, a 55 gallon drum may be used as the supply for the treatment chemical. A larger or smaller container may be used as necessary depending on the rate at which the treatment chemical will be used. When one container is emptied a full container is substituted for it.

The supply of the treatment chemical is connected to a pumping apparatus for injecting the treatment chemical into the flowing stream. Generally, the connection is accomplished by piping or tubing using conventional methods and equipment. The connection provides a means for the treatment chemical to flow from the supply to the pumping apparatus.

The pumping apparatus used for injecting the treatment chemical into the flowing stream must provide a constant flow of the treatment chemical. Preferably, the constant flow positive displacement pumping apparatus of the invention is used to provide constant injection of the treatment chemical.

It should be appreciated that devices other than the constant flow pumping apparatus of the invention may be used to provide the constant injection of treatment chemicals. For example, conventional gear pumps will provide a relatively constant output of a treatment chemical for the purposes of providing a constant injection of the treatment chemical into a flowing stream. Further, the pressurization of a reservoir of the treatment chemical may also be used to achieve a relatively constant injection of a desired treatment chemical. A pulsation dampening device may also be used in combination with an intermittent pump such as a conventional positive displacement pump to achieve a relatively constant injection of a treatment chemical.

The pumping apparatus means is typically connected to the flowing stream using piping or tubing. The pumping apparatus may also be directly connected to the flowing stream. Conventional methods and equipment are used to make these connections. Typically, a backflow prevention device will be incorporated into the connection between the pumping apparatus and the flowing stream to prevent any flow of the flowing stream into the pumping apparatus or treatment system.

Overall the constant injection method operates by having treatment chemical flow from the supply to the pumping apparatus and from the pumping apparatus to the flowing stream. Thus, a constant amount of the treatment chemical is injected continuously into the flowing stream to achieve a uniform concentration of the treatment chemical in the flowing stream.

CONSTANT FLOW PUMPING APPARATUS

Referring to FIG. 1 a schematic view of the constant flow positive displacement pumping apparatus is shown. The pumping apparatus includes a cam 10, a cam shaft 12, a housing 14, a first cylinder 16, a second cylinder 18, a first cylinder piston assembly 20, a second cylinder piston assembly 22, a first cylinder spring 28, and a second cylinder spring 30. The housing 14 is square in shape.

The cam shaft 12 runs horizontally through apertures on opposite sides of the housing 14. Bearings and seals (not shown) are provided where the cam shaft 12 passes through the holes in the sides of the housing 14. Preferably, commercially available silicone shaft seals are used because the silicone is more resistant to attack from oil or liquids in the housing. The bearings and seals are preferably held in place by a collar mounted on the cam shaft adjacent to the inside walls of the housing. Collars are provided to prevent the bearings and seals from slipping out of the housing. The collars are secured on the cam shaft by a set screw or some other conventional means for securing a collar on a shaft.

The cam shaft 12 runs through the housing 14 so that it is perpendicular to the cylinders 16 and 18. The cam shaft 12 is located centrally in the housing so that the end of each cylinder and piston is equally distant from the cam shaft.

The cam 10 is mounted on the cam shaft 12 by means of a hole drilled in the cam through which the cam shaft is inserted. The cam 10 is held in position on the shaft by a pin inserted into a hole drilled through cam and into the shaft.

One end of each cylinder 16 and 18 is threaded. The threaded ends of the cylinders 16 and 18 screw into threaded holes on opposite sides of the housing 14. The cylinders 16 and 18 are located on the sides of the housing 14 so that they are perpendicular to the cam shaft 12 but in the same plane as the cam shaft. The cylinders are held in place by locking nuts 32 and 34 which are threaded onto the threaded ends of the cylinders 16 and 18 before the cylinders are screwed into the housing 14. The locking nuts 32 and 34 are tightened against the outside of the housing 14 after the cylinders 16 and 18 are screwed into the housing so that the cylinders are locked in place.

Preferably, single threaded ports 36 and 38 are located on the ends of each cylinder 16 and 18 opposite to the housing 14. The ports 36 and 38 function as the inlet and outlet for liquid being pulled into the cylinders 16 and 18 or liquid being discharged from those cylinders. Single ports are used instead of separate inlet and outlet ports because it is easier to drill one threaded port in each cylinder. Preferably, the ports are located on the top portion of the end of each cylinder to allow any gas that enters the cylinder to escape during a discharge stroke.

Alternately, separate inlet and outlet ports may be provided in each cylinder. This would require extra drilling into the cylinder. It would also require a thicker cylinder wall than would otherwise be required if the inlet and outlet ports were drilled in the sides of the cylinder instead of the end. Inlet and outlet ports in the sides of the cylinder also present the possibility that a fitting is threaded so far into the cylinder that it could rub against the piston spring and cause it to fail.

T-Fittings 40 and 42 are screwed into the threaded ports 36 and 38 in the ends of cylinders 16 and 18. Preferably, the T-fittings are oriented in a vertical direction. Check valves 50 and 51 are attached to the bottom holes of the T-fittings 40 and 42. Likewise, check valves 52 and 53 are attached to the top holes of T-fittings 40 and 42. The bottom check valves function as the suction check valves for supplying liquid to the cylinders. The top check valves function as discharge check valves for liquid being discharged from the cylinders.

It should be appreciated that check valves are constructed so that liquid will only flow through the valve in one direction. The suction check valves 50 and 51 are oriented so that liquid will flow from the supply line through the check valves and T-fittings and into the cylinders. The discharge check valves 52 and 53 are oriented so that liquid will flow from the cylinders through the T-fittings and check valves to the discharge line. The check valves insure that during a suction stroke liquid will only be pulled in through the suction hole of the T-fittings and during a discharge stroke liquid will only be discharged through the discharge hole of the T-fittings.

The discharge check valves 52 and 53 are connected to discharge lines that have drain valves 54 and 55. One of the discharge lines then includes another check valve 56. The two discharge lines are then joined to provide a single discharge line.

This configuration is useful to determine if a particular piston and cylinder combination has failed. By opening the drain valve 54 it is possible to tell if both piston and cylinder combinations are working or if one piston and cylinder combination has failed. If a steady flow is observed at drain valve 54 it means that both pumps are working. If no flow is observed at drain valve 54 it means that neither pump is working. If a pulsating flow is observed at drain valve 54 then only one pump is working. If drain valve 55 is then opened it is possible to tell which pump is working. A pulsating flow of liquid at drain valve 55 indicates that cylinder 18 is discharging liquid. No flow at drain valve 55 indicates that cylinder 16 is discharging liquid and cylinder 18 is not discharging liquid.

Preferably, the suction check valves 50 and 51 are connected to a common supply of the liquid that is being pumped. The connections between the check valves and suction and discharge lines are made from conventional piping, tubing, or similar conduits used for transferring fluids.

Commercially available check valves may be used for check valves 50, 51, 52, 53, and 56. Appropriate materials must, of course, be used for the check valves to insure that the check valves are made of materials that are compatible with the liquid being pumped. For example, teflon o-ring check valve seats are generally preferred because teflon is impervious to most liquids. Further, the check valves must be carefully selected to insure that the pressure required to cause liquid to flow through the check valve is appropriate for the particular application. For example, the suction check valves cannot require a force greater than atmospheric pressure to open. Otherwise it would be constantly closed and never open. Also, in an application for pumping viscous liquid the discharge check valve must have a great enough seating force to seat the valve.

Each cylinder 16 and 18 is hollow and opens into the interior of the housing 14. Piston assemblies 20 and 22 are fitted into the cylinders 16 and 18. The piston assemblies 20 and 22 can freely slide in the cylinders 16 and 18. Consequently, a chamber is formed between the end of each piston assembly and corresponding cylinder. When the piston assembly slides into the cylinder the chamber is decreased in volume and liquid in the chamber is discharged—this is the discharge stroke for the piston assembly. When the piston assembly slides out of the cylinder the chamber is increased in volume and liquid is pulled into the chamber—this is the suction stroke for the piston assembly.

Springs 28 and 30 are inserted into the cylinders 16 and 18 before the piston assemblies 20 and 22 are inserted. The springs seat against the end of the cylinders and the end of the piston assemblies to provide a mechanical force pushing the pistons away from the T-fitting ends of the cylinders. The springs provide the motive force for the suction strokes of the pistons by pushing the pistons away from the T-fitting ends of the cylinders and creating a suction on the suction line through the suction check valves. Commercially available stainless steel springs which provide 45 pounds of force are used for the piston springs 28 and 30.

Figure 2:
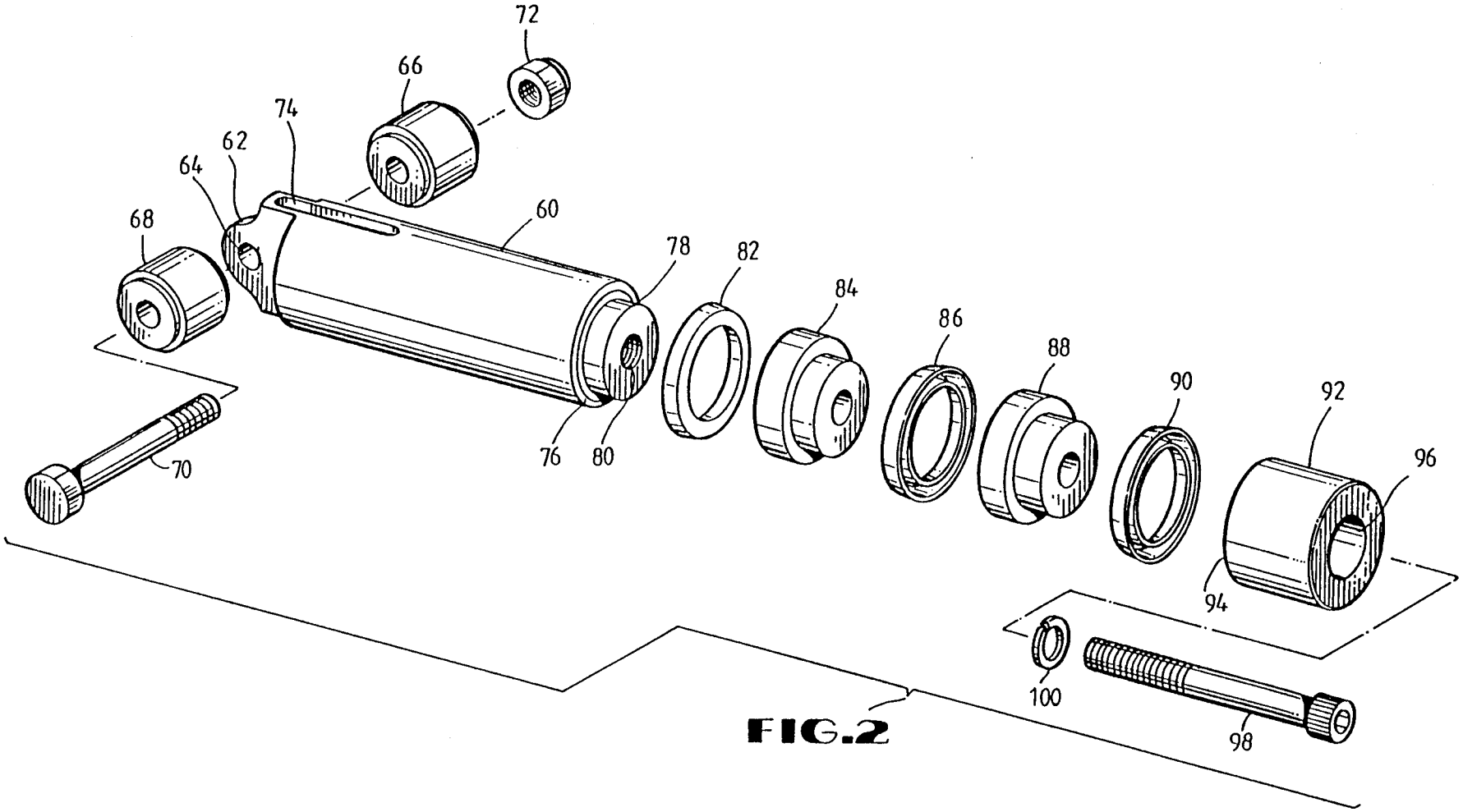
FIG. 2 depicts an exploded view of a piston assembly for the constant flow positive displacement pump.
Figure 3:
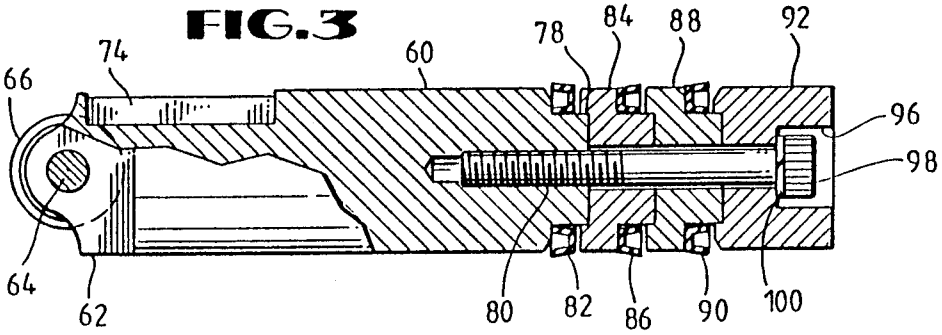
FIG. 3 depicts a cut-away view of a piston assembly for the constant flow positive displacement pump in assembled form.

Referring to FIGS. 2 and 3, an exploded schematic view of a piston assembly and a cross-sectional view of an assembled piston assembly are depicted. The piston assembly consists of a driving part 60; two roller bearings 66 and 68; a bolt and nut 70 and 72; three ring seals 82, 86, and 90; two spacers 84 and 88; a piston end 92; and a hex head screw 98 with a locking washer 100. The driving part 60 is ground down at one end to form a flat sided end 62. The flat sided end 62 has a hole 64 drilled through it from one side to the other. Roller bearings 66 and 68 are positioned flush against either side of the flat sided end 62 so that their holes correspond to the hole 64 in the flat sided end. A bolt 70 is inserted through the holes of the roller bearings 66 and 68 and the flat sided end 62. A nut 72 is threaded onto the bolt 70 and tightened to secure the roller bearings to the driving part of the piston. The piston assembly is positioned in the cylinder so that the roller bearings are in a horizontal plane.

A notch 74 is cut into the top surface of the driving part 60 and extends into the flat sided end 62. The notch 74 is provided to receive a guiding bar 44 (shown in FIG. 1).

The end of the driving part 60 opposite to the flat sided end 62 has a bevel 76. The end is further reduced in radius to form a cylindrical end 78. A threaded hole 80 which extends axially into the driving part 60 is provided at the center of the cylindrical end 78. The driving part 60 is made from hardened steel to minimize wear caused by contact of the sides of the driving part with the inner surface of the cylinder due to nonaxial forces experienced by the piston assembly. It should be appreciated that ideally the sides of the driving part would not contact the inner surface of the cylinder.

A ring seal 82 fits on the cylindrical end 78 of the driving part 60. The ring seal has a thickness slightly less than the length of the cylindrical end 78. A spacer 84 is fitted against the cylindrical end 78 of the driving part 60. The spacer 84 has a recess on the end that fits against the cylindrical end 78 of the driving part 60. The recess has a slightly larger diameter than the diameter of the cylindrical end 78. The opposite end of the spacer 84 has a cylindrical end like the cylindrical end 78 of the driving part 60. The spacer 84 also has a hole drilled axially through its center.

A ring seal 86 fits on the cylindrical end of the spacer 84. Another spacer 88 is fitted against the spacer 84. The spacer 88 is identical to part 84 and includes a recess for accepting the cylindrical end of spacer 84. A ring seal 90 is fitted over the cylindrical end of spacer 88. The cylindrical end of each spacer 84 and 88 is slightly longer than the thickness of ring seals 86 and 90.

Commercially available ring seals which are made from teflon impregnated with carbon are used for ring seals 82, 86, and 90. The ring seals provide a seal between the inner surface of the cylinder and the piston assembly. At the same time the ring seals allow the piston assembly to slide in the cylinder.

Referring to FIG. 3, the inner and outer surfaces of the rings seals are tapered. On one flat side of each ring seal the thickness of the ring seal in a radial direction is less than the thickness on the other flat side of the ring seal. This provides that the side of the ring seal with the greatest radial thickness fits tightly between the inner surface of the cylinder and the cylindrical end of the piston assembly part. The side of the ring seal with the least radial thickness has a solid surface. The side of the ring seal with the greatest radial thickness is hollowed out and a spring is inserted to maintain the shape of the ring. This is required because the teflon material of the ring seal has a tendency to lose its shape.

Ring seals 82, 86, and 90 are oriented in a particular manner. Ring seal 82 which provides a seal during the suction stroke is oriented on the cylindrical end 78 so that the hollowed out side of the ring faces towards the driving part 60. During the suction stroke of the piston the hollowed out side of the ring is facing the cam area of the pump which is filled with oil. As the piston is pushed towards the cam by the piston spring the oil is forced into the hollowed out portion of the ring and this provides pressure on the edges of the ring seal to insure that it seals against the inner surface of the cylinder and the outer surface of cylindrical end 78. The bevel 76 on the driving part 60 is provided to accommodate the flow of oil into the hollowed out portion of the ring seal 82.

Rings seals 86 and 90 which provide a seal during the discharge stroke are oriented so that the hollowed out portions of the ring seals face away from the driving part 60. During the discharge stroke the piston assembly is moving away from the cam and liquid in the chamber formed by the cylinder and piston assembly is forced into the hollowed out portion of these ring seals. This insures that the edges of the ring seals fits tightly against the inner surface of the cylinder and the outer surfaces of the spacers 84 and 88 on which the ring seals are fitted. The bevel 94 on piston end 92 is provided to accommodate the flow of liquid into the hollowed out portion of ring seal 90.

Only one ring seal is required for the suction stroke because the maximum pressure that this ring seal must seal against is atmospheric pressure. Two ring seals are used for the discharge stroke because the maximum pressure that these ring seals must seal against is usually greater than atmospheric pressure.

The length of the cylindrical ends of the driving part 60 or spacers 84 and 88 that the ring seals 82, 86, and 90 fit on are slightly larger than the axial thickness of the ring seals to allow the seals to shift slightly during the reverse in movement of the piston assembly as it switches from a suction stroke to a discharge stroke and then back to a suction stroke. This allows the seals to seat properly and prevents undue wear.

A carbon impregnated teflon ring seal is preferred because it provides superior wear resistance when compared to other types of materials. The inner surface of the cylinder is polished with at least a number 8 hone to further decrease wear on the ring seas. The surfaces of the cylindrical end 78 of the driving part 60 and the cylindrical ends of the spacers 84 and 88 which contact the ring seals 82, 86, and 90 are also polished with at least a number 8 hone to reduce wear on the ring seals.

Other materials could be used for the ring seals. Further, other methods could be used to provide a seal between the piston assembly and the inner surface of the cylinder. For example, commercially available o-rings could be used to provide the seal between the piston assembly and the cylinder. Further, a sealing device could be provided on the inner surface of the cylinder instead of on the piston. If the sealing device were on the inner surface of the cylinder then the piston assembly surfaces would likely have to be polished to reduce wear on the sealing device.

Referring to FIG. 1, the roller bearings of the piston assemblies 20 and 22 are maintained in constant contact with the surface of the cam 10 due to force exerted on the piston assemblies by the springs 28 and 30. Ideally, the roller bearings turn with no frictional resistance. This would insure that force is only transmitted to or from the cam surface directionally along the axis of the piston assemblies. Realistically, the roller bearings turn with some friction as the cam rotates and nonaxial forces are exerted on the piston assemblies. These non-axial forces waste energy and cause wear on the piston assemblies and cylinders.

It should be appreciated that other methods could be used for contacting the piston end with the cam surface. For example, a single roller bearing could be mounted on the end of the piston. This would be accomplished by including a fork on the end of the piston assembly, and the single roller bearing would be mounted between the tines of the fork. It is even possible to use a sharp edge at the end of the piston to contact the cam surface. This would be less desirable, however, because the sharp edge would be subject to high wear and would subject the piston to greater non-axial forces than a roller bearing.

The rotation of the cam 10 causes the displacement of the piston assemblies 20 and 22 in an axial direction in the cylinders 16 and 18. The displacement of the piston assemblies 20 and 22 occurs because the radius of cam (i.e., the distance between the center of rotation of the cam and the surface of the cam) at the points of contact with the piston assemblies is changing as the cam rotates. When the radius of the cam is increasing at points of contact with the piston assemblies 20 and 22, the liquid in the cylinders 16 and 18 is discharged from the cylinder ports 36 and 38 because the piston assemblies are moving into the cylinders. Likewise, when the radius of the cam is decreasing at a point of contact with a piston assembly, liquid is being pulled into the cylinder through the cylinder port because the piston assembly is moving out of the cylinder.

For example, a circular cam mounted on a shaft going through its center would have no change in radius as it rotated and would produce no displacement in a piston assembly contacting the cam surface. On the other hand, a circular cam mounted on a shaft offset from the center of the cam would have a change in radius as it rotated around the shaft and would produce a displacement in a piston assembly contacting the cam surface. Likewise, a non-circular cam such as an oblong shaped cam would have a change in radius as it rotated and would produce a change in the displacement of a piston assembly contacting the cam surface. Thus, the displacement of a piston assembly being driven by a cam will depend on the change in radius of the cam at the point where the piston assembly contacts the cam surface.

If the rate of change in the radius of the cam as it rotates past a particular point is a constant positive number then the rate of discharge of liquid from a cylinder and piston assembly contacting and being driven by that cam at that point will be constant. Likewise, if multiple piston assemblies are being driven by a cam, and the sum of the rates of change in the radius of the cam at the points where the cam contacts and drives those piston assemblies is constant then the combined discharge rate from all piston assemblies will be constant.

The cam of the constant flow pumping apparatus is designed so that the sum of the rates of change in the radius of the cam at the points where the cam surface contacts each piston assembly as it rotates is constant. The negative rate of change of the cam during the suction stroke for each piston assembly is treated as zero for summing the rates of change in the radius of the cam because during the suction stroke for a particular piston the discharge from that cylinder is zero.

Figure 5:
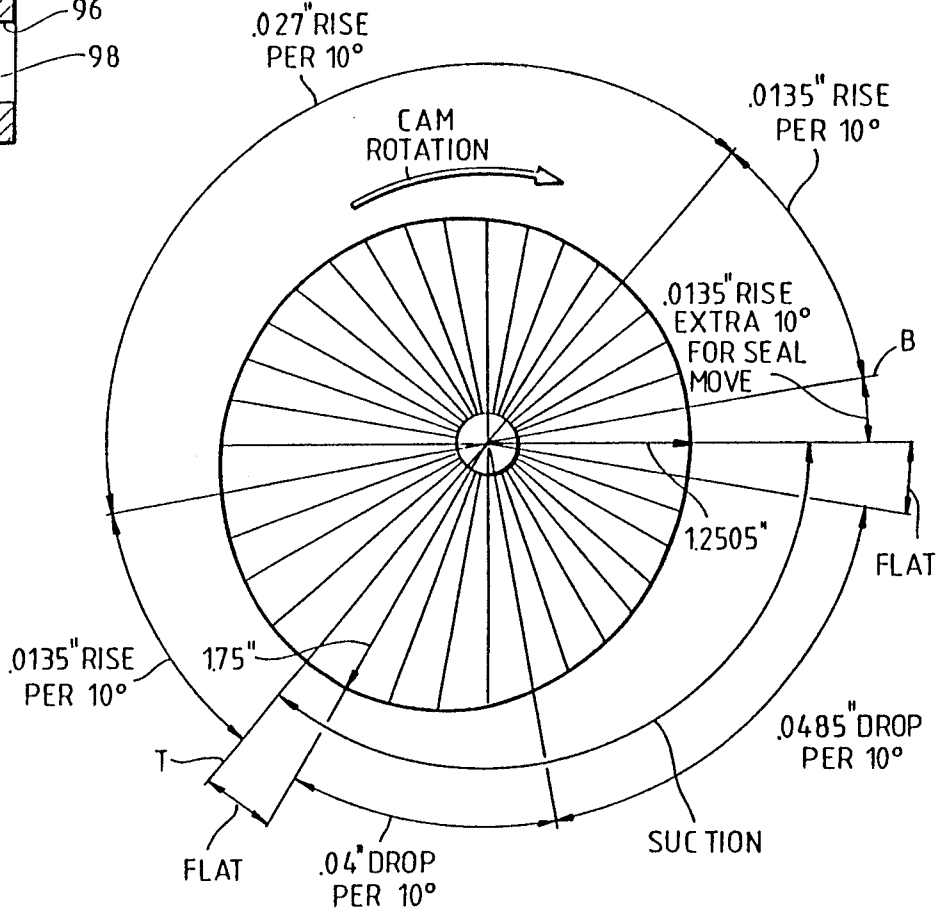
FIG. 5 depicts the geometry of the cam surface.

Referring to FIG. 5, the geometry of the cam surface of the constant flow pumping apparatus is depicted. Points B and T represent the transition points between the suction stroke and discharge stroke portions of the cam surface. When the cam has rotated so that point B contacts a piston assembly, that piston assembly has substantially achieved minimum displacement into the cylinder and the liquid chamber is essentially at its largest volume. Likewise, when the cam has rotated so that point T contacts a piston assembly, that piston assembly has achieved maximum displacement into the cylinder and the liquid chamber is at its smallest volume.

It should be appreciated that the direction of rotation of the cam is important. For example, if the cam depicted in FIG. 5 rotates in a clockwise direction then the portion of the cam surface between point T and point B moving clockwise from point T corresponds to the discharge stroke. Likewise, the portion of the cam surface between point B and point T moving clockwise from point B corresponds to the suction stroke. When the cam depicted in FIG. 5 rotates in a clockwise direction the sum of the rates of change in the radius of the cam at points 180 degrees apart, where the cam surface contacts the piston assemblies, are constant throughout the full rotation of the cam.

If the cam is rotated in a counterclockwise direction, then the portions of the cam surface corresponding to the discharge and suction strokes are reversed. And the sum of the rates of change in the radius of the cam at the points where it contacts the piston assemblies would no longer be constant. A cam could be designed, however, that would provide a constant sum for the rates of change in the radius of the cam at the points where the piston assemblies contacted the cam surface when the cam rotated in a counterclockwise direction.

Referring to FIG. 5 the radius of the cam at point B is 1.2640 inches. The radius at point T is 1.75 inches. Assume that one piston contacts the cam surface where point B is located and a second piston contacts the cam surface on the opposite side of the cam at a point 180 degrees around the cam from point B. As the cam rotates in a clockwise direction the cam surface in contact with the pistons moves in a clockwise direction. This is the same as moving along the cam surface in a counterclockwise direction from a point on the cam surface with the cam held stationary.

Moving counterclockwise from point B on the cam surface, the cam radius increases by 0.0135 inches per every 10 degrees for the first 40 degrees. The cam radius next increases at a rate of 0.027 inches per every 10 degrees for the next 140 degrees. Then the cam radius increases by 0.0135 inches per every 10 degrees for 40 degrees. This 220 degree portion of the cam surface where the cam radius is increasing corresponds to the discharge stroke.

Moving counterclockwise from point T on the cam surface the cam radius does not change for the first 10 degrees. The cam radius then decreases by 0.04 inches per every 10 degrees for 40 degrees, and then decreases by 0.0485 inches per every 10 degrees for 70 degrees. The radius of the cam then does not change for 10 degrees, and finally increases by 0.0135 inches for the next 10 degrees. This 140 degree portion of the cam surface corresponds to the suction stroke.

The first 10 degree portion of the cam surface moving counterclockwise from point T which has no change in the cam radius is provided to allow the suction ring seal to shift and seat as the piston assembly reverses direction and starts its suction stroke. Likewise, the 20 degree portion of the cam surface immediately clockwise from point B with the rise for 10 degrees and then no change in the cam radius is provided to allow the discharge ring seals to shift and seat as the piston assembly reverses direction and starts its discharge stroke. The rise for 10 degrees also prevents a dead spot in the flow from the pumping apparatus that would otherwise occur.

The overall effect of this geometry is that sum of the increase of the radius of the cam for any two opposite 10 degree increments on the surface of the cam is 0.027 inches per every 10 degrees. The 140 degree portion on the cam surface where the cam radius is increasing is opposite to the suction stroke portion of the cam surface where radius is decreasing of not changing. The 40 degree portions of the cam surface where cam radius is increasing by 0.0135 inches per every 10 degrees are opposite, and thus the sum of the rate of change cam radius for these two portions of the cam surface is 0.027 inches per every 10 degrees.

The 10 degree portion of the cam surface immediately clockwise from point B when summed with its opposite 10 degree portion of the cam surface does not add up to 0.027 inches per every 10 degrees for the rate of change in cam radius. Instead the sum for the rate of change in cam radius is 0.0405 because the 10 degrees clockwise from point B increases by 0.0135 inches and its opposite 10 degrees increases by 0.027 inches. This exception to the constant sum for the rates of change in cam radius prevents the dead spot that would otherwise occur due to the switch from the suction stroke to the discharge stroke. It should be appreciated that this is not necessarily required but is preferred for operational reasons.

The value for constant sum of the rates of change of the cam radius for opposite points can be varied depending on the particular application. An increase in this value provides a greater displacement for the piston assemblies and results in a greater pump capacity because more liquid is discharged during each stroke. An increase in the sum of the rates of change in the cam radius for opposite points has the disadvantage that the cam will require more torque to rotate and will exert greater non-axial forces on the pistons leading to piston assembly and cylinder wear. A decrease in the value for the constant sum of the rates of change of the cam radius for opposite points on the cam surface will decrease pumping capacity, but will decrease torque and energy requirements for running the pump, and decrease wear on the pistons and cylinders.

The cam is made from commercially available materials such as steel. It is machined to produce the proper geometry for the surface. The surface is then hardened by conventional metal hardening techniques to minimize wear on the cam surface from contact with the roller bearings of the piston assemblies.

Figure 4:
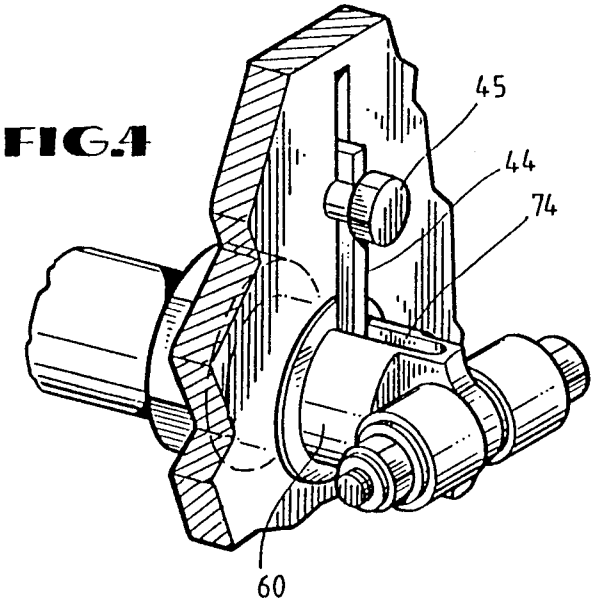
FIG. 4 depicts a schematic view of the guiding mechanism and piston assembly end for the constant flow positive displacement pump.
Figure 6:
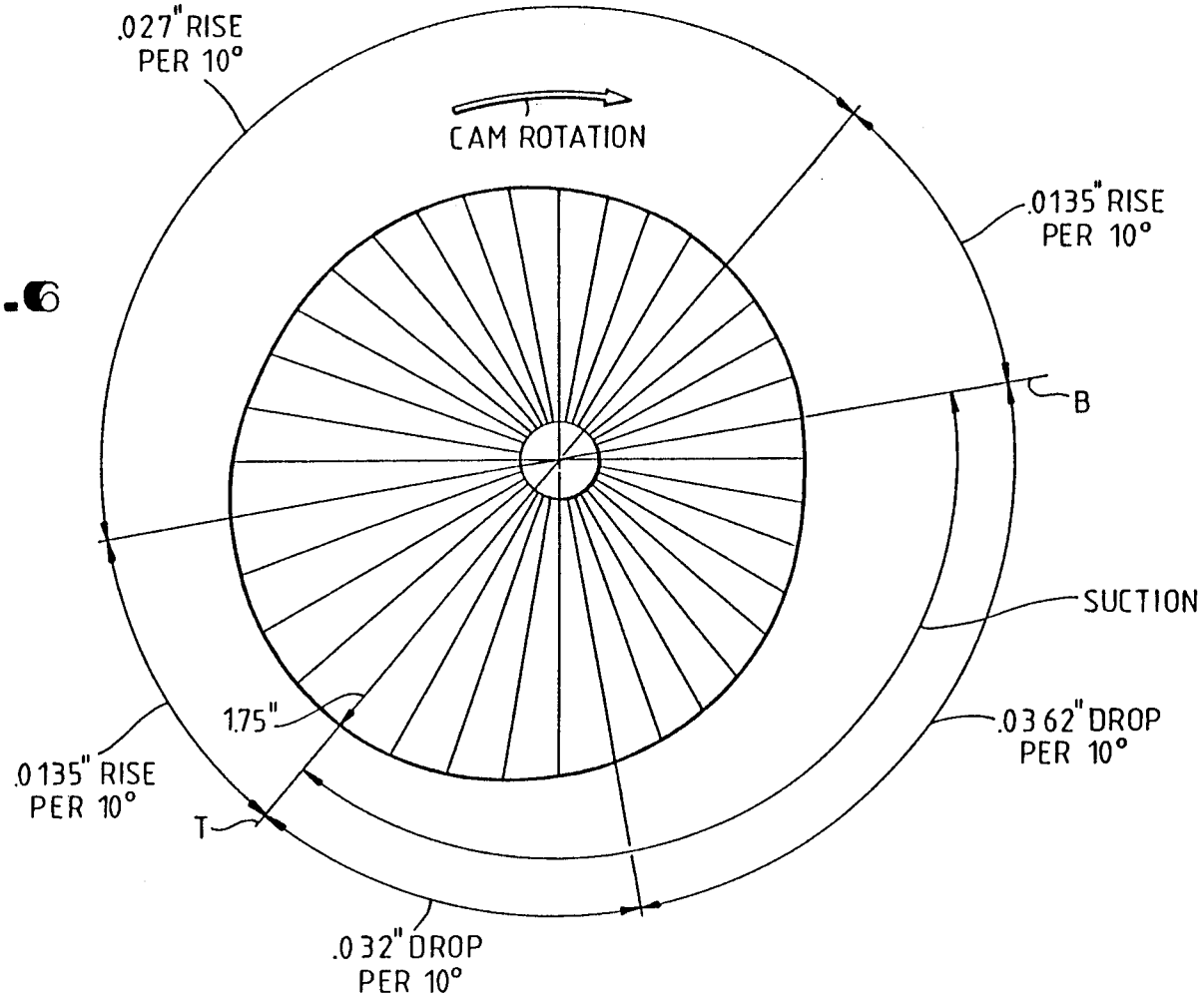
FIG. 6 depicts an alternate geometry of the cam surface.

Referring to FIG. 4 a guiding mechanism is attached to the inside of the housing to prevent the pistons from rotating in the cylinders. The guiding mechanisms consists of a metal bar 44 attached to the housing 14 by a bolt 45 with a slot which is threaded into a hole in the housing. The bar 44 extends downward into the slot 74 of the driving end 60 of the piston assembly. The guiding bar can freely slide within the slot of the of the driving part of the piston assemblies. The guiding mechanisms prevent the pistons from rotating which would cause the roller bearings to become misaligned with the cam surface.

Referring to FIG. 1 the cam shaft 12 of the pumping apparatus is driven by a commercially available motor and gear drive 48. Preferably, the cam shaft is coupled to the motor and gear drive with a flexible coupling. Other coupling methods can be used but a commercially available flexible coupling has been more effective than a rigid coupling. A commercially available variable speed gear drive is used between the motor and the shaft. The gear drive allows the speed of the cam shaft to be adjusted thereby changing the number of strokes of the piston assemblies and the flow rate delivered by the pumping apparatus. A variable speed motor could also be used for this purpose.

A pumping apparatus according to the invention which uses a pair of piston assembly and cylinder combinations with piston diameters of 1 inch has flow rate capacities ranging from approximately ½ to 240 gallons per day. The rotational speed of the shaft can be varied from approximately 0 to 50 revolutions per minute. It should be appreciated that a wider range of flow rates could be achieved by using smaller or larger piston assemblies and cylinders in the pumping apparatus, or by using a greater number of piston assemblies and cylinder combinations in the apparatus, or by using a different gear ratio on the variable speed drive.

The housing of the pumping apparatus is designed to completely enclose the cam and piston assembly ends. Further, the housing is kept filled with oil during operation of the pumping apparatus. The oil level is maintained so that it covers the roller bearings of the piston assemblies and the majority of the cam. This provides lubrication to minimize wear on the roller bearings, pistons, cam, and cam shaft. A drain plug is provided at the bottom side of the housing to accommodate draining the oil when it is changed.

Changes and modifications in the specifically described embodiments can be carried out without departing from the scope of the invention. The invention is intended to be limited only by the scope of the appended claims.

For example, the cam can be modified in many ways while still achieving a constant combined rate of displacement for the positive displacement pumps. In one alternative a cam shaft with multiple cams could be used to drive two or more piston and cylinder combinations—one piston and cylinder combination per cam. The cam surfaces would be designed and the cams would be oriented on the cam shaft in a manner that would cause the combined displacement of all pistons to be a constant value. In another alternative a single cam could be used to drive two piston and cylinder combinations but the combinations would not be located on opposite sides of the cam surface. This alternative would allow piston and cylinder combinations in different orientations relative to the cam surface and would only be restricted to the extent that the combinations could not be so close together that both pistons experienced their suction stroke at the same time. In a further alternative three or more piston and cylinder combinations could be driven by the same cam without the necessity for oppositely placed pistons. This could be accomplished by designing the cam surface so that at any given time two combinations were discharging liquid at a constant rate while the third combination was in its suction stroke.

The method of driving the suction stroke could be modified. For example, the suction stroke could be driven by the cam instead of a spring by providing a recessed T shaped slot in the cam surface. The roller bearings of the piston would fit in the T shaped slot so that during the discharge stroke the cam would push the piston into the cylinder and during the discharge stroke the cam would pull the piston from the cylinder. The T shaped slot would, of course, follow the shape of the cam surface.

It would be possible for a single pumping apparatus to supply a constant flow of multiple liquids. This would be accomplished by using a pumping apparatus with more than one pair of piston and cylinder combinations. Each pair of piston and cylinder combinations would be connected to a separate supply of liquid and could then be joined to provide a single flow of liquid or maintained separately to provide multiple flows of liquids.

Other methods than the guiding bars described above are possible for insuring that the pistons do not rotate in the cylinder. For example, a roller bearing affixed to the housing could be provided to support the roller bearing end of the pistons. These roller bearings would be positioned immediately below and in contact with the roller bearings of the pistons. They would insure that the pistons could not rotate and would also provide support to offset non-axial forces experienced by the pistons.

EXAMPLE 1

A test loop was constructed to investigate axial dispersion of a liquid which was injected into a flowing liquid using both a conventional diaphragm pump and a constant flow pump. The flow loop was made of 50 feet of clear flexible ⅜ inch (inner diameter) plastic tubing. A constant flow of water with a flow rate of 10 feet per second was passed through the flow loop. A red dye was injected into the flowing water at the start of the flow loop using both a conventional diaphragm pump and a novel continuous pump. The axial dispersion of red dye was visually observed as the water flowed through the flow loop for both the diaphragm pump and the continuous pump.

The diaphragm pump was typical of conventional positive displacement pumps which provide an intermittent nonconstant flow of liquid. The diaphragm pump completed 1 cycles per second. The discharge stroke of the diaphragm pump lasted ½ second and the return stroke lasted ½ second. Each cycle of the diaphragm pump corresponded to an amount of the water traveling 10 feet in the flow loop. The capacity of the pump was 3 gallons per hour.

At a setting of 50% of the rated capacity of the diaphragm pump, dye was injected for ¼ second which corresponded to an amount of water flowing 2.5 feet through the flow loop. Thus, a section of water 2.5 feet long contained red dye immediately after injection. No dye was injected by the pump for ¾ second which corresponded to an amount of water flowing 7.5 feet through the flow loop. Thus, a section of water 7.5 feet long had no red dye. The water flowing through the flow loop contained alternating sections of treated water and untreated water.

After a treated section of water had traveled 50 feet (5 seconds later) through the flow loop from the point of injection the treated section expanded slightly was not significantly greater than 2.5 feet as observed by the length of the water section that contained red dye. The corresponding water section with no red dye was slightly less than 7.5 feet in length. Further, because the dye and water were polar liquids, the axial dispersion was greater than would otherwise be expected.

Visual observations of the flow loop after red dye was injected by a prototype of the constant flow pump indicated a relatively constant concentration of red dye throughout the treated water as it flowed through the flow loop. Variations within the sections of water that contained red dye were not readily discernible. The constant flow pump had a capacity of about 12 gallons per hour.

EXAMPLE 2

The method of the invention was tested in an ethylene production plant. The test involved three towers used for ethylene fractionation. The three towers all experienced corrosion problems in overhead lines caused by exposure to acetic acid.

A prototype of the constant flow pumping apparatus was connected to the overhead lines in two of the three towers. The pumps were used to inject monoethanolamine, a neutralizing agent, to reduce the acidity of the overhead stream and inhibit corrosion. Approximately 4000 pounds per day of monoethanolamine were injected.

Initially, in the absence of chemical treatment for corrosion, measured iron concentrations in the overhead streams of the towers ranged from 10–15 ppm (parts per million). Further, corrosion probe activity was measured for the overhead streams as 600 mils (1 mil = 1/1000 of an inch) per year. After beginning the continuous chemical treatment the iron concentration in the overhead stream was reduced to less than 0.1 ppm. Likewise, the corrosion probe activity was reduced to 0 mils per year.

On one occasion, the constant flow pump on one tower became intermittent and operated similar to conventional pumps used for injecting treatment chemicals. Subsequently, the iron concentration and corrosion probe measurements began to increase appreciably, although not back to untreated levels.

A conventional intermittent pump was added to the third tower to inject monoethanolamine. Regardless of the amount of treatment chemical added by the conventional pump, the 10–15 ppm iron concentration levels could not be reduced below 1–2 ppm, and were often higher. Corrosion probe measurements could not be reduced below 10–15 mils per year.

EXAMPLE 3

The method of the invention was also tested in a crude oil processing unit in an oil refinery which experienced corrosion problems. Previously, a crude fractionating tower in the unit was treated with a corrosion inhibitor using conventional intermittent pumps. No success was achieved by using the conventional methods for injecting the treatment chemical for a period of more than one year.

An experiment was attempted to treat the unit with the same treatment chemical as was used previously but using the method of the invention to inject the corrosion inhibitor. After a period of time the crude oil processing unit was taken out of service or brought down for "turnaround" in refining terms. The overhead system was examined. Observations and measurements of the inside of the overhead lines and equipment used in the crude oil processing unit indicated that there was no corrosion.

What is claimed is:

1. A pumping apparatus for delivering a constant flow of liquid, the apparatus comprising:

a) one or more pairs of piston/cylinder combinations, each of the combinations comprising a piston and a cylinder, wherein each of the pistons is displaced into and out of the corresponding cylinder such that liquid is drawn into the cylinder when the piston is displaced out of the cylinder, and liquid is discharged from the cylinder when the piston is displaced into the cylinder at a rate proportional to the rate of displacement of the piston into the cylinder; and b) a rotatable cam, the cam comprising;

a surface which contacts an end of each of said pistons so that the piston is displaced into and out of the corresponding cylinder when the cam rotates, the pistons in each pair of piston/cylinder combinations contact the cam surface at points which are 180 degrees out-of-phase from each other; and a center of rotation, wherein the distance between the cam surface and the cam center varies as a function of the angle as the cam is rotated, and the distance between the cam surface and the cam center has a minimum value at an angle of 0 degrees and a maximum value at an angle of about 220 degrees, wherein the distance between the cam surface and cam center increases at a first constant rate from an angle of 0 degrees to about 40 degrees, wherein the distance between the cam surface and cam center increases at a second constant rate from an angle of about 40 degrees to about 180 degrees, said second constant rate being twice the first constant rate, wherein the distance between the cam surface and cam center increases at the first constant rate from an angle of about 180 to an angle of about 220 degrees, wherein the distance between the cam surface and cam center decreases from an angle of about 220 degrees to an angle of about 360 degrees.

2. The apparatus of claim 1 wherein each piston/cylinder combination further comprises a spring, the spring connected to the cylinder and the piston such that it exerts a force on the piston to maintain the contact between the piston end and the cam surface.

3. The apparatus of claim 2, wherein the force exerted by the spring causes the piston to be displaced out of the cylinder.

4. The apparatus of claim 1 where the cam is further adapted to be driven by a motor.

5. The apparatus of claim 1 further comprising suction and discharge check valves for each cylinder, each suction check valve adapted to communicate with its corresponding cylinder such that liquid will only flow into the cylinder when the piston is moving out of that cylinder, and each discharge check valve adapted to communicate with its corresponding cylinder such that liquid will only flow out of the cylinder when the piston is moving into that cylinder.

6. The apparatus of claim 1 further comprising roller bearings attached to the end of each piston such that the roller bearings contact the cam surface.

7. The apparatus of claim 1 further comprising a guiding means which prevents the pistons from rotating in the cylinders.

8. The apparatus of claim 1 wherein the distance between the cam surface and the cam center does not change from an angle of about 220 to about 230 degrees.

9. The apparatus of claim 1 wherein the distance between the cam surface and the cam center does not change from an angle of about 350 to 360 degrees.

10. The apparatus of claim 1 wherein the distance between the cam surface and the cam center does not change from an angle of about 340 to about 350 degrees and increases at the second constant rate from an angle of about 350 to about 360 degrees.

11. A pumping apparatus for delivering a constant flow of liquid, the apparatus comprising:

a) one or more pairs of piston/cylinder combinations, each of the combinations comprising a piston and a cylinder, each of said cylinders comprising suction and discharge check valves, wherein each said suction check valve is adapted to communicate with its corresponding cylinder such that liquid will only flow into the cylinder when the piston is displaced out of that cylinder, and each said discharge check valve adapted to communicate with its corresponding cylinder such that liquid will only flow out of the cylinder when the piston is displaced into that cylinder, wherein liquid is discharged from the cylinder at a rate proportional to the rate of displacement of the piston into the cylinder each of said cylinders further comprising a drain valve, said drain valve connected to an outlet side of the discharge check valve, a means for interconnecting the outlet sides of the discharge check valves to form a common discharge line, and a check valve in the interconnecting means; and b) a rotatable cam, the cam comprising, a surface which contacts an end of each of said pistons so that the piston is displaced into and out of the corresponding cylinder when the cam rotates, the pistons in each pair of piston/cylinder combinations contact the cam surface at points which are 180 degrees out-of-phase from each other; and a center of rotation, wherein the distance between the cam surface and the cam center varies as a function of the angle as the cam is rotated and the distance between the cam surface and the cam center has a minimum value at an angle of 0 degrees and a maximum value at an angle of about 220 degrees, wherein the distance between the cam surface and cam center increases at a first constant rate from an angle of 0 degrees to about 40 degrees, wherein the distance between the cam surface and cam center increases at a second constant rate from an angle of about 40 degrees to about 180 degrees, said second constant rate being twice the first constant rate, wherein the distance between the cam surface and cam center increases at the first constant rate from an angle of about 180 to an angle of about 220 degrees, wherein the distance between the cam surface and cam center decreases from an angle of about 220 degrees to an angle of about 360 degrees.

12. A method for determining if the pumping apparatus of claim 11 is working, the method comprising:

a) opening the drain valve which sees the flow for both cylinders because it connects with the interconnecting means check valve;

b) observing the flow from the drain valve wherein full flow indicates that both cylinders are discharging liquid, no flow indicates that neither cylinder is discharging liquid, and pulsating flow indicates that only one cylinder is discharging liquid;

c) opening the drain valve for the other cylinder if pulsating flow is observed in step b); and d) observing the flow from the drain valve wherein a pulsating flow indicates that the cylinders communicating with that valve and drain is discharging liquid, while no flow indicates that the cylinder communicating with that valve and drain is not discharging.

* * * * *